United States Patent [19]

Ziesel et al.

[11] Patent Number: 4,917,831

[45] Date of Patent: Apr. 17, 1990

[54] BUOYANT TANK CARBONATOR PUMP CONTROL FOR POST-MIX BEVERAGE APPARATUS

[75] Inventors: Lawrence B. Ziesel, Marietta; Robert D. Hughes, Atlanta, both of Ga.

[73] Assignee: The Coca-Cola Company, Atlanta, Ga.

[21] Appl. No.: 330,175

[22] Filed: Mar. 29, 1989

[51] Int. Cl.[4] ..... B01F 3/04

[52] U.S. Cl. ..... 261/27; 261/120; 261/DIG. 7; 137/189; 137/488

[58] Field of Search ..... 261/DIG. 7, 27, 120; 137/408, 189

[56] References Cited

U.S. PATENT DOCUMENTS

| | | | |
|---|---|---|---|
| 639,631 | 12/1899 | Tufts et al. | 261/DIG. 7 |
| 1,253,941 | 1/1918 | Copeland | 137/408 |
| 1,538,204 | 5/1925 | Mueller | 261/27 |
| 2,339,640 | 1/1944 | Holinger | 261/DIG. 7 |
| 2,488,423 | 11/1949 | Mooney | 137/408 |
| 2,514,361 | 7/1950 | Baker | 261/27 |
| 2,575,267 | 11/1951 | Gottlieb | 137/408 |
| 2,628,825 | 2/1953 | Kantor et al. | 261/27 |
| 3,465,771 | 9/1969 | Tishler | 137/408 |
| 4,743,367 | 5/1988 | Zeilon | 261/120 |
| 4,764,315 | 8/1988 | Brusa | 261/27 |

*Primary Examiner*—Tim Miles

*Attorney, Agent, or Firm*—Birch, Stewart, Kolasch & Birch

[57] ABSTRACT

A carbonator unit for a post-mix beverage dispenser having a carbonator tank immersed in a liquid flotation tank. The carbonator tank floats up and down with changes in the amount of water and head space in the carbonator tank to actuate a switch device mounted externally of the carbonator tank. Actuation of the switch causes a water pump to become operative to supply uncarbonated water to the carbonator tank. When the volume of carbonated water increases to a predetermined amount, the carbonator tank sinks to deactivate the switch.

20 Claims, 2 Drawing Sheets

BUOYANT TANK CARBONATOR PUMP CONTROL FOR POST-MIX BEVERAGE APPARATUS

BACKGROUND OF THE INVENTION

This invention relates generally to carbonation apparatus for supplying carbonated water to post-mix beverage apparatus and more particularly to apparatus for controlling the supply of water to a carbonator tank as demand for carbonated water changes.

Carbonation apparatus, generally referred to as a carbonator, used in connection with post-mix carbonated beverage dispensers, for example, is generally known and includes means for supplying both uncarbonated water and carbon dioxide gas to a carbonator tank wherein the two are mixed to form carbonated water. It also includes a conduit for transporting the carbonated water, which extends from the carbonator tank to a post-mix dispensing nozzle where the carbonated water is mixed with a quantity of flavor concentrate or syrup. The carbonator also normally includes some type of water pump to supply uncarbonated (still) water to the carbonator tank depending upon a sensed level of water in the tank. Both mechanical and electrical pump configurations have been utilized. In order to control the pump, some type of pump control is required to supply water in response to the level of carbonated water in the carbonator tank.

One type of pump control is known wherein a carbonator tank is mounted on a balance beam which has other components of the overall carbonator apparatus mounted on the opposite end of the beam. As the water level rises or falls in the carbonator tank, the tank will move up or down with the beam due to changes in weight of the tank, and the supply of water will be automatically controlled in response to this change in weight.

SUMMARY OF THE INVENTION

Accordingly, it is an object of the present invention to provide an improvement in apparatus for making and dispensing carbonated water.

It is another object of the invention to provide an improvement in the control of the supply of water to the carbonator for beverage dispensing apparatus.

It is a further object of the invention to provide an improved apparatus for controlling the dispensing of carbonated water in a post-mix beverage dispenser.

And yet a further object of the invention is to provide an improvement in the control of a pump utilized for supplying uncarbonated (still) water to a carbonator unit in a post-mix beverage dispenser.

The foregoing and other objects are realized by a carbonator unit for a post-mix beverage dispenser having a carbonator tank immersed in a liquid flotation tank such as a water bath reservoir. The carbonator tank floats up and down with changes in the amount of water and head space therein. A switch device is mounted externally of the carbonator tank and is actuated thereby to control water supplied to the carbonator through a pump. Accordingly, buoyant forces associated with the entire carbonator unit are utilized to control water supply.

BRIEF DESCRIPTION OF THE DRAWING

The invention will be more readily understood when the following detailed description of the invention is considered in light of the accompanying drawings, wherein:

FIG. 2 is a mechanical schematic diagram illustrative of a second embodiment of the invention.

DETAILED DESCRIPTION OF THE INVENTION

Figure 1:
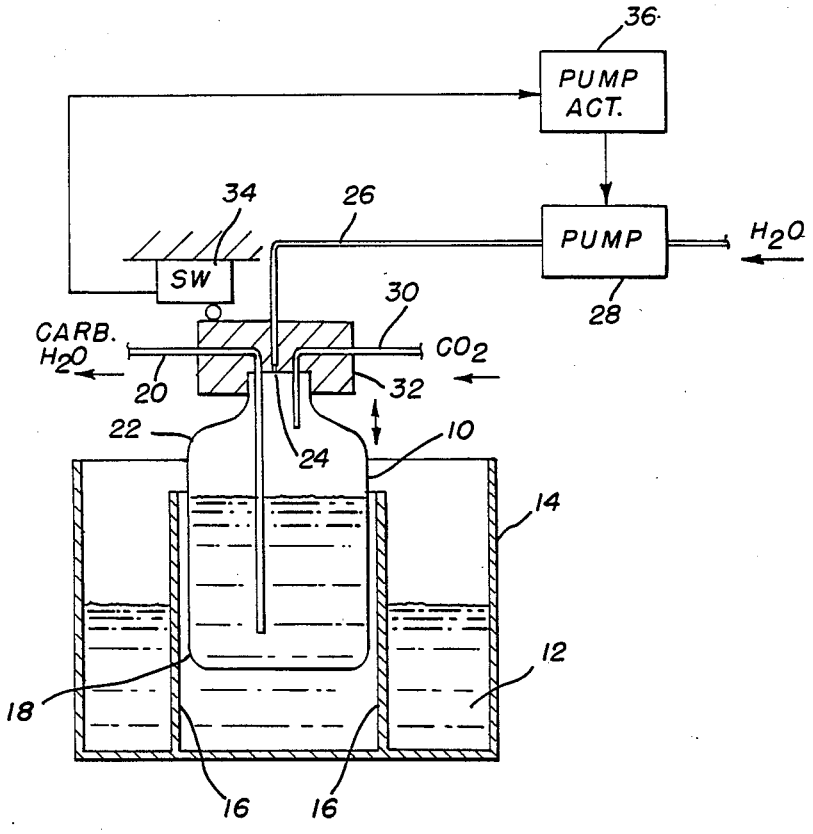
FIG. 1 is a mechanical schematic diagram illustrative of one embodiment of the invention.

Referring now to the drawings and more particularly to FIG. 1, reference numeral 10 denotes a carbonator tank formed in the general shape of a bottle which is manufactured from plastic material, for example polyetheylene terephthalate, and which is oriented upright and immersed in a volume of liquid 12, e.g. water, confined within a flotation tank container 14 which is open at the top. Two or more vertical guide members 16 are located interiorally of the container 14 to restrict lateral movement of the carbonator tank/bottle 10 within the container 14.

The carbonator tank 10 is adapted to contain a variable amount of carbonated water 18 which is fed to a mixing nozzle, not shown, via a flexible tube or conduit having an end section which extends down into the carbonated water 18 to a predetermined depth into the tank 10. Changes in the amount of the carbonated water 18 and the head space depend on the amount of uncarbonated water introduced thereto through an orifice coupled to the end of a second flexible tube or conduit 26 which is connected to the output of a water pump 28 of any selected design and which may include either electrical, mechanical or pneumatic apparatus. The pump 28, in turn, is connected to a supply source of uncarbonated or still water, not shown.

Carbon dioxide ($CO_2$) gas is introduced into the tank 10 by means of a third flexible tube or conduit 30 connected to a source of $CO_2$, not shown. All three tubes or conduits 20, 26 and 30 pass through an adapter or fitting 32, including the orifice 24, affixed to the open ended top of the tank 10 at or above the neck portion thereof. The fitting 32 or an extension thereof acts as a switch actuator for a switch device 34, e.g. an electrical microswitch, which is mounted externally of and above the container 14 so as to be actuated by the upward movement of the tank as it floats upwardly due to depletion of the volume 18 of carbonated water therein. The switch 34 is connected to a pump actuator 36 which turns the pump 28 on and off, depending upon the open and closed state of the switch 34. If the pump 28 comprises an electric pump, the microswitch 34 can be connected directly to the pump.

Thus the immersed carbonator tank floats up and down depending upon the amount of carbonated water 18 it contains. When the amount of carbonated water 18 depletes to a predetermined level, the buoyant forces associated with the carbonator tank 10 causes it to float upwardly until the fitting 32 contacts the switch device 38. This in turn activates the pump 28, causing water to be fed into the tank through the orifice 24 where it mixes with carbon dioxide introduced via the conduit 38. The mixed carbon dioxide and water accumulates in the tank 10, causing it to descend vertically in the container 14 under the constraints of the guide members 16. Upon descent of the carbonator tank, the switch device is deactivated and the pump 28 turns off, inhibiting any further flow of uncarbonated or still water into the carbonator tank 10.

A second embodiment of the invention is shown in FIG. 2 and also uses the buoyant force principle in controlling the pump 28. As shown, a metal carbonator tank 10' replaces the plastic bottle configuration of FIG. 1. The metal tank 10' additionally includes an elongated cylindrical neck portion 11 which extends through an opening 13 in the top wall 15 of a closed water tank 17 which acts as the flotation reservoir for the carbonator tank 10'. Additionally, a compression spring member 19 is located around the neck portion 11 between the outer surface of the top wall 15 and the under surface of the fitting 32 which, as noted before, acts as the actuator for the switch device 34. The spring in addition to supplying a biasing force on the carbonator tank 10', causing it to move in an upward direction so as to close the switch device 34, also acts in combination with the opening 13 to constrain movement of the carbonator tank 10' in a vertical direction, thereby also restricting lateral movement. As the carbonator tank 10' fills with water, the additional weight causes the tank 10 to descend vertically into the water bath 12 against the biasing action of the spring 19 whereupon at a predetermined level the switch 34 is opened, causing the water pump 28 to turn off. When the carbonated water 18 thereafter becomes depleted, the tank 10' will rise and again actuate the switch 34 to turn the pump 28 on.

Although such apparatus is relatively simple in design, it is nevertheless reliable and effective in controlling the amount of water fed to the carbonator tank on demand.

Having thus shown and described what is at present considered to be the preferred embodiment of the invention, it should be noted that the same has been made by way of illustration and not limitation. Accordingly, all modifications, alterations and changes coming within the spirit and scope of the invention are herein meant to be included.

We claim:

1. Carbonator apparatus, comprising:

a first container for holding a predetermined volume of liquid therein;

a second container holding a variable volume of carbonated water resulting from mixing a quantity of water and carbon dioxide, said second container being constrained to move in a vertical direction and floatable in said volume of liquid in said first container;

means for feeding carbon dioxide from an external source into said second container;

control means for feeding water from an external source into said second container to vary said volume of carbonated water and thus the flotation level of said second container in said first container;

means for feeding carbonated water out of said second container; and means responsive to the flotation level of said ;, second container for causing said control means to maintain the volume of carbonated water at a predetermined quantity.

2. The carbonator apparatus of claim 1 wherein said control means includes a water pump.

3. The carbonator apparatus of claim 1 wherein said second container comprises a carbonator tank.

4. The carbonator apparatus of claim 3 and additionally including means for restricting lateral movement of said second container while permitting free vertical movement thereof.

5. The carbonator apparatus of claim 3 wherein said means responsive to the flotation level comprises switch means and additionally include switch actuator means on the top portion of said second container.

6. The carbonator apparatus of claim 5 wherein said control means includes a water pump and wherein said switch means controls the operation of the water pump.

7. The carbonator apparatus of claim 6 wherein said first container comprises a flotation tank.

8. The carbonator apparatus of claim 7 wherein said carbonator tank includes a body portion, and a neck portion extending from said body portion and terminating in a mouth portion, and wherein said switch actuator means is located at said neck and mouth portions.

9. The carbonator apparatus of claim 8 wherein said carbonator tank comprises a bottle type carbonator and additionally including guide means located in said flotation tank for restricting lateral movement of said carbonator tank.

10. The carbonator apparatus of claim 8 and additionally including spring bias means located on said neck portion for urging said actuator means into contact with said switch means.

11. The carbonator apparatus of claim 10 wherein said carbonator tank comprises a metal tank having an elongated cylindrical neck portion.

12. The carbonator apparatus of claim 8 and wherein said switch actuator means includes means for closing the mouth portion of said carbonator tank.

13. The carbonator apparatus of claim 12 wherein said means for feeding carbon dioxide, said means for feeding water in, and said means for feeding water out each include conduits feeding into said carbonator tank through said means for closing the mouth portion.

14. The carbonator apparatus of claim 8 wherein said switch means comprises an electrical switch and said water pump comprises an electrical pump.

15. Carbonator apparatus, comprising:

an outer flotation tank comprising a first container including a predetermined volume of liquid;

an inner carbonator tank comprising a second container containing a variable volume of carbonated water resulting from mixing a quantity of water and carbon dioxide gas, said carbonator tank being buoyant in said volume of liquid in said flotation tank;

conduit means for feeding carbon dioxide gas from an external source into said carbonator tank;

pump means and conduit means connected thereto for feeding water from an external source into said second container to vary said volume of carbonated water and thus the flotation level of said second container in said first container;

conduit means for feeding carbonated water out of said second container; and means responsive to the flotation level of said carbonator tank for controlling said pump means to maintain the volume of carbonated water at a predetermined quantity in said carbonator tank.

16. The carbonator apparatus of claim 15 wherein said volume of liquid comprises a volume of water.

17. The carbonator apparatus of claim 15 wherein said inner carbonator tank comprises a bottle-type container.

18. The carbonator apparatus of claim 15 wherein said outer flotation tank includes means for restricting lateral movement of said inner carbonator tank.

19. The carbonator apparatus of claim 15 wherein said carbonator tank includes a body portion for holding said variable volume of carbonated water and an elongated neck portion for receiving the extremities of said conduit means.

20. The carbonator apparatus of claim 19 and additionally including spring means around said neck portion for stabilizing said carbonator tank generally vertically in said flotation tank.

* * * * *